US006050880A

United States Patent [19]

Kato et al.

[11] Patent Number: 6,050,880

[45] Date of Patent: Apr. 18, 2000

[54] SURFACE GRINDING DEVICE AND METHOD OF SURFACE GRINDING A THIN-PLATE WORKPIECE

[75] Inventors: Tadahiro Kato, Shirakawa; Sadayuki Okuni; Hideo Kudo, both of Fukushima-ken; Hiroshi Tomioka, Tokyo, all of Japan

[73] Assignee: Shin-Etsu Handotai Co., Ltd., Tokyo, Japan

[21] Appl. No.: 08/996,190

[22] Filed: Dec. 22, 1997

[30] Foreign Application Priority Data

Dec. 26, 1996 [JP] Japan ..... 8-356999

[51] Int. Cl.[7] ..... B24B 1/00

[52] U.S. Cl. ..... 451/41; 451/57; 451/287; 451/289; 451/388

[58] Field of Search ..... 451/364, 388, 451/397, 398, 285, 288, 289, 283, 41, 28, 57, 58, 287; 438/690, 691, 692, 693; 216/88, 89

[56] References Cited

U.S. PATENT DOCUMENTS

| | | | |
|---|---|---|---|
| 4,597,228 | 7/1986 | Koyama et al. . | |
| 4,625,463 | 12/1986 | Sekiya | 451/388 |
| 5,762,539 | 6/1998 | Nakashiba et al. | 451/388 |

FOREIGN PATENT DOCUMENTS

| | | |
|---|---|---|
| 539896A1 | 5/1993 | European Pat. Off. . |
| 699504A1 | 3/1996 | European Pat. Off. . |
| 62-162455 | 7/1987 | Japan . |

*Primary Examiner*—Derris Holt Banks
*Attorney, Agent, or Firm*—Nikaido Marmelstein Murray & Oram LLP

[57] ABSTRACT

A surface grinding method for a thin-plate workpiece is provided including the steps of (a) roughly surface grinding a first surface of a thin-plate workpiece using a thin-plate workpiece surface grinding device to create a reference plane having no sori or waviness; (b) inverting the thin-plate workpiece, the first surface of which has been roughly surface ground and, with a surface grinding device having a hard chucking plate, chucking the first surface to the hard chucking plate to roughly surface grind a second surface of the thin-plate workpiece; (c) chucking to the hard chucking plate the first surface of the thin-plate workpiece, the second surface of which has been roughly surface ground with the surface grinding device having the hard chucking plate to further finely surface grind the second surface of the thin-plate workpiece; and (d) inverting the thin-plate workpiece, the second surface of which has been finely surface ground and, with the surface grinding device having the hard chucking plate, chucking the second surface to the hard chucking plate to further finely surface grind the first surface of the thin-plate workpiece, wherein the surface grinding device comprising a surface grinding element; and a holding element for holding the thin-plate workpiece to be surface ground, wherein the holding element is a soft holding element. An alternate surface grinding method for a thin-plate workpiece is also provided in which steps (a) and (b) are the same as above and in which steps (c) and (d) are as follows: (c) chucking to the hard chucking plate the second surface of the thin-plate workpiece, the second surface of which has been roughly surface ground with the surface grinding device having the hard chucking plate to finely surface grind the first surface of the thin-plate workpiece; and (d) inverting the thin-plate workpiece, the first surface of which has been finely surface ground and, with the surface grinding device having the hard chucking plate, chucking the second surface to the hard chucking plate to finely surface grind the second surface of the thin-plate workpiece.

18 Claims, 10 Drawing Sheets

TTV=0.90μm

TTV=0.89μm

SURFACE GRINDING DEVICE AND METHOD OF SURFACE GRINDING A THIN-PLATE WORKPIECE

BACKGROUND OF THE INVENTION

1. Field of the Invention

The present invention relates to a surface grinding device and to a method for surface grinding a thin-plate workpiece having a sori(warp or bow) or waviness component which is 10 to 30 mm in a period or cycle. More particularly, the present invention is directed to a device and method for surface grinding of a thin-plate workpiece, well suited to surface grinding of a wafer immediately after being sliced by a wire saw or an inner diameter saw (hereinafter referred to also as an "as-cut wafer").

2. Description of the Related Art

In general, a semiconductor wafer is prepared through a slicing step for slicing a silicon ingot that has been pulled by a Czochralski method, into a plurality of thin-plate discs by use of an inner diameter saw or a multi-wire saw, and subjecting the as-cut wafer that has been obtained through the slicing step, to the respective processes of a chamfering step, a lapping step, an etching step, a surface polishing step, and a cleaning step in the stated order.

The as-cut wafer immediately after being sliced has an irregular configuration of plural periods in a bowl-shaped or S-shaped period. In particular, irregularities of 30 mm or more in a bowl-shaped or S-shaped period are called "sori" (warp or bow), and irregularities of 10 to 30 mm in the period are called "waviness". Those irregularities occur in the case where a slicing blade does not go straight due to a slight difference in slicing resistance between the right and left sides of the slicing blade when slicing the wafer, and more particularly they become remarkable in the case where a wire saw is used.

In recent years, a larger diameter a wafer size and a higher flatness level in wafer shape have been strictly demanded with a high integration of the semiconductor devices using such wafers, and it has become difficult for a conventional wafer preparing process to satisfy those demands. In order to meet those demands from customers, surface grinding is very hopeful instead of lapping. In case of adopting this surface grinding processing, a method for preparing a semiconductor wafer may be composed of a slicing step, a chamfering step, a surface grinding step, a polishing step, and a cleaning step, or a slicing step, a chamfering step, a surface grinding step, an etching step, a polishing step, and a cleaning step, etc.

As shown in FIGS. 10 and 11, in general, in a conventional surface grinding device 72, as a system for holding and fixing the wafer, there is employed a system in which one surface of a wafer (W) to be ground is held under vacuum onto a hard chucking plate 76 such as a porous ceramic plate having a large number of through holes 74 via a suction hole 78 that is connected to a vacuum pump, and the other surface thereof is ground by a grinding wheel 80.

However, in the case where the vacuum chucking system in the above-mentioned conventional surface grinding device 72 is applied to a system for supporting an as-cut wafer (W) such as the semiconductor wafer, the waviness on the back surface of the wafer (W) is elastically deformed in conformity with a chucking surface formed in a high flatness due to a vacuum chucking force as shown in FIG. 10.

Upon the surface grinding of the wafer (W), a high flatness level thereof can be obtained since the wafer (W) is vacuum chucked during grinding operation. However, when the vacuum chucking is released after the completion of the grinding operation, an elastically deformed portion of the ground wafer (W) is restored, and a shape of the back surface of the wafer (W) remains in such a manner as transferred to the front surface thereof, thereby making it impossible to obtain a wafer having a predetermined shape.

In particular, a small irregularity having a relatively short period (irregularity of a roughness level) is readily removed even by the conventional surface grinding technique because the shape of the back surface of the wafer (W) is not transferred to the front surface thereof. However, the waviness having a long period of 10 to 30 mm is difficult to remove.

The present inventors made various investigations to solve the problems with the above conventional technique, as a result of which they developed a novel surface grinding method and device, and already proposed the same in Japanese Patent Laid-Open Publication No. 8-66850 and Japanese Patent Application No. 8-80719.

The former is excellent in that the irregularity of the back surface of the wafer can be prevented from being transferred to the front surface thereof by a process in which the back surface of the wafer is held by an adhesive material such as wax in such a manner that it is not elastically deformed, and the front surface of the wafer is then ground. However, since this technique requires steps for coating and removing the wax, there are disadvantages in manufacturing costs and manufacturing time, which should be improved.

The latter is a method of reducing a vacuum chucking pressure by which the wafer is held and fixed to prevent the irregularity of the back surface of the wafer from being transferred to the front surface thereof. Although this technique can remarkably reduce the waviness, there still remains a problem that it can not completely eliminate the waviness.

SUMMARY OF THE INVENTION

The present invention has been made in view of the above problems, and therefore an object of the present invention is to provide a device and method for surface grinding of a thin-plate workpiece, which is capable of performing surface grinding to substantially remove, particularly, the waviness of 10 to 30 mm in a period of a thin-plate workpiece having a sori(warp or bow) or waviness component without deterioration of the flatness and without entirely requiring an equipment investment, and which is also capable of preparing a semiconductor wafer with a high quality having no waviness at low costs, which does not require the conventional lapping process and, as occasion demands, the etching process, in the case where the invention is applied to surface grinding of an as-cut wafer.

In order to solve the above problems, according to the present invention, there is provided a device for surface grinding a thin-plate workpiece, comprising a surface grinding element, and a holding element for holding the thin-plate workpiece to be surface ground, characterized in that a soft holding element is used as said holding element.

The waviness of 10 to 30 mm in period of the thin-plate workpiece can be absorbed by the use of said soft holding element. The soft holding element is preferably structured so that a holding surface of the holding element is made of a soft material.

The soft holding element is preferably formed of a thin-plate workpiece chucking plate on an upper surface of which a porous soft material sheet defining chucking holes for chucking the thin-plate workpiece therein is stuck.

The soft holding element may be formed of a thin-plate workpiece fixing plate on an upper surface of which a soft material sheet is stuck.

The porous soft material sheet which is stuck on the thin-plate workpiece chucking plate is preferably formed of a synthetic resin sheet made of one or more kinds of materials selected from a group consisting of polystyrene resins, vinyl chloride resins, polyurethane resins, phenol resins, epoxy resins and polyethylene resins.

The soft material sheet which is stuck on the thin-plate workpiece fixing plate is preferably formed of a foamed resin sheet which is 1 mm or less in thickness and made of one or more kinds of materials selected from a group consisting of polystyrene resins, vinyl chloride resins, polyurethane resins, phenol resins, epoxy resins and polyethylene resins.

The use of the foamed resin sheet increases static friction between the thin-plate workpiece and the soft material sheet, thereby being capable of preventing separation of the thin-plate workpiece.

The thin-plate workpiece surface grinding device is formed of a vertical spindle rotary table surface grinding machine, preferably an infeed grinding machine using a cup type grinding wheel.

In a method of surface grinding a thin-plate workpiece according to a first aspect of the present invention, the thin-plate workpiece having a sori(warp or bow) or wavines component is surface ground using the above thin-plate workpiece surface grinding device to remove the sori(warp or bow) or waviness.

According to a second aspect of the present invention, there is provided a method of surface grinding a thin-plate workpiece comprising the steps of: roughly grinding one surface of a thin-plate workpiece using the above thin-plate workpiece surface grinding device, to create a reference plane having no sori(warp or bow) or waviness; inverting the thin-plate workpiece one surface of which has been roughly surface ground and, with a surface grinding device having a hard chucking plate, chucking the one surface to the hard chucking plate to roughly surface grind the other surface of said thin-plate workpiece; chucking to the hard chucking plate the one surface of the thin-plate workpiece the other surface of which has been roughly surface ground with the surface grinding device having the hard chucking plate to further finely surface grind the other surface of said thin-plate workpiece; and inverting the thin-plate workpiece the other surface of which has been finely surface ground and, with the surface grinding device having the hard chucking plate, chucking the other surface to the hard chucking plate to further finely surface grind the one surface of said thin-plate workpiece.

According to a third aspect of the present invention, there is provided a method of surface grinding a thin-plate workpiece comprising the steps of: roughly grinding one surface of a thin-plate workpiece using the above thin-plate workpiece surface grinding device, to create a reference plane having no sori or waviness; inverting the thin-plate workpiece the one surface of which has been roughly surface ground and, with a surface grinding device having a hard chucking plate, chucking the one surface to said hard chucking plate to roughly surface grind the other surface of said thin-plate workpiece; chucking to the hard chucking plate the other surface of the thin-plate workpiece the other surface of which has been roughly surface ground with the surface grinding device having the hard chucking plate to finely surface grind the one surface of said thin-plate workpiece; and inverting the thin-plate workpiece the one surface of which has been finely surface ground and, with the surface grinding device having the hard chucking plate, chucking the other surface to the hard chucking plate to finely surface grind the other surface of said thin-plate workpiece.

The grain size of the diamond abrasive grains used for the grinding wheel is large in rough surface grinding and small in fine surface grinding. Examples of the thin-plate workpiece which is subjected to the surface grinding according to the present invention may include a semiconductor wafer or a quartz wafer.

The present inventors paid their first attention to the fact that, in order to enable the surface grinding of the thin-plate workpiece without transferring the waviness component of 10 to 30 mm in period to the front surface of the workpiece, the thin-plate workpiece must be surface ground with the workpiece being not elastically deformed when chucking or holding and fixing the workpiece. The thin-plate workpiece having the waviness component is fixed to a soft chucking plate so that the workpiece is prevented from being elastically deformed when grinding, thereby preventing the shape of a back surface of the workpiece from being transferred to a front surface thereof.

However, there has been found that when using the soft chucking plate, if a soft material is used for the entire holding plate, the rigidity of a wafer holding base, per se, which fixes the wafer deteriorates with the result that a ground wafer with a high flatness level could not be finally obtained. In view of this fact, the present inventors found out that a wafer from which the waviness component is removed and which is high in flatness can be obtained when the soft material that absorbs the waviness component while maintaining the rigidity of the wafer holding base is applied only to the front surface of the chucking plate. Thus, the present inventors completed the present invention.

According to the present invention, there can be obtained a remarkable advantage, such that surface grinding can be performed to substantially remove, particularly, the waviness of 10 to 30 mm in period of a thin-plate workpiece having a sori(warp or bow) or waviness without deterioration of the flatness and without entirely requiring an equipment investment. Also, the present invention can obtain a remarkable advantage that a semiconductor wafer can be manufactured with a high quality having no waviness at low costs, which does not require the conventional lapping process and, as occasion demands, the etching process, in the case where the invention is applied to a surface grinding processing of an as-cut wafer.

BRIEF DESCRIPTION OF THE DRAWINGS

The above and other objects, features and advantages of the present invention will become more apparent from the following detailed description when taken in conjunction with the accompanying drawings wherein.

DETAILED DESCRIPTION OF THE PREFERRED EMBODIMENTS

Now, a description will be given in more detail of one preferred embodiment of the present invention with reference to the accompanying drawings. It should be noted that the dimensions, configuration, relative position, and so on, of the structural components which are described in this embodiment do not particularly limit the scope of the present invention without specific description, and do not exceed a mere descriptive example.

Figure 1:
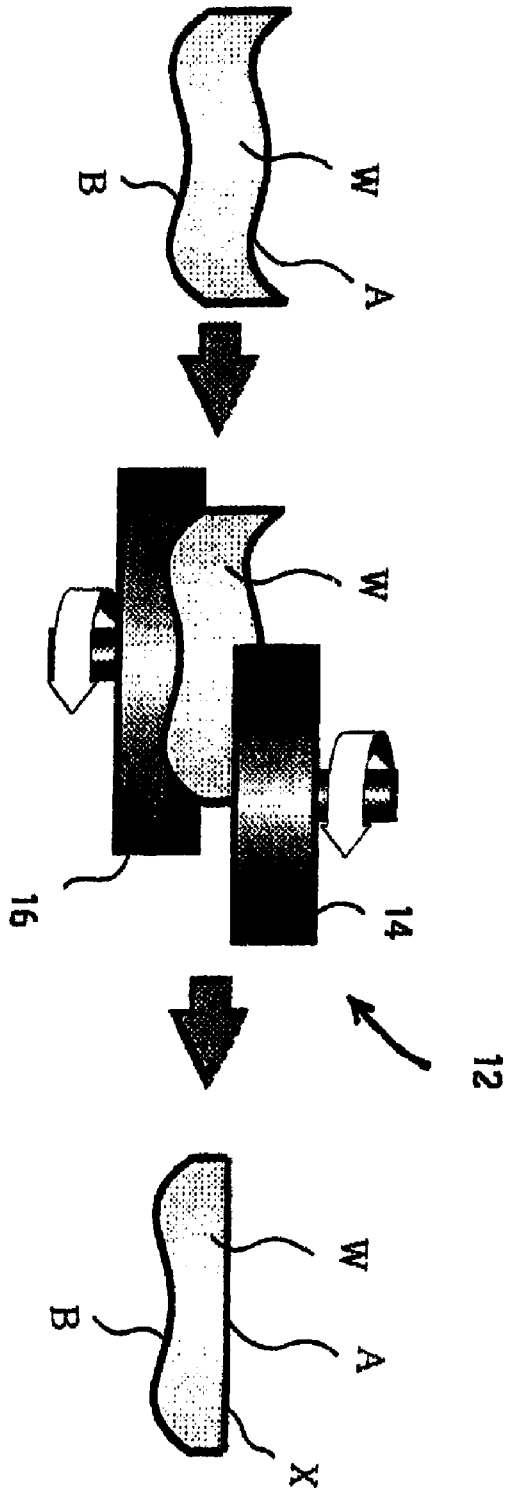
FIG. 1 is an explanatory side view showing a surface grinding device according to one embodiment of the present invention.

In FIG. 1, reference numeral 12 denotes a device for surface grinding a thin-plate workpiece according to the present invention, which includes a surface grinding element, for example, a grinding wheel 14, and a soft holding element 16 that chucks or holds and fixes a thin-plate workpiece (W) which is surface ground.

The thin-plate workpiece (W) may be, for example, a semiconductor wafer or quartz wafer. The thin-plate workpiece (W) shown in FIG. 1 is an as-cut wafer, and irregularities indicated on upper and lower surfaces of the wafer are shown in the figure with emphasizing a sori(warp or bow) or waviness component.

The most significant feature of the device for surface grinding the thin-plate workpiece according to the present invention resides in that the soft holding element 16 is used for chucking or holding and fixing the thin-plate workpiece (W).

A soft holding plate may be used as the soft holding element 16. The soft holding plate can be applied with the structure of a soft chucking plate 16*a* shown in FIG. 2 or the structure of a soft fixing plate 16*b* shown in FIG. 3.

Figure 2:
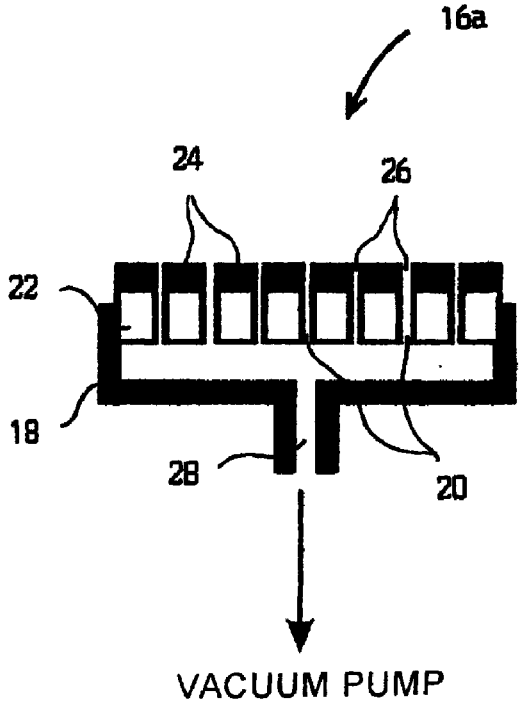
FIG. 2 is an explanatory cross-sectional view showing a soft chucking plate structure for a thin-plate workpiece in the surface grinding device according to the present invention.

The soft chucking plate 16*a* is, as shown in FIG. 2, made up of a chucking plate 18, a porous hard plate 22 which is attached to the chucking plate 18 and is made of a porous hard material such as porous ceramics having a large number of through holes 20, and a soft material 24 which is stuck onto an upper surface of the porous hard plate 22.

A suction hole 28 which is connected to a vacuum pump is defined in a lower portion of the chucking plate 18. Also, the soft material 24 is formed in a sheet, and a large number of chucking holes 26 for chucking the thin-plate workpiece are defined in the soft material sheet 24.

When the thin-plate workpiece (W) is mounted on the upper surface of the soft material 24 to actuate the vacuum pump, the thin-plate workpiece (W) is vacuum chucked and fixed onto the upper surface of the soft material 24.

The porous soft material 24 is formed of a porous synthetic resin sheet made of one or more kinds of materials selected from a group consisting of polystyrene resins, vinyl chloride resins, polyurethane resins, phenol resins, epoxy resins and polyethylene resins.

In case of using the above-described soft chucking plate 16*a*, the thin-plate workpiece (W) can be fixed by vacuum chucking through the porous soft material sheet 24 without accompanying elastic deformation.

Figure 3:
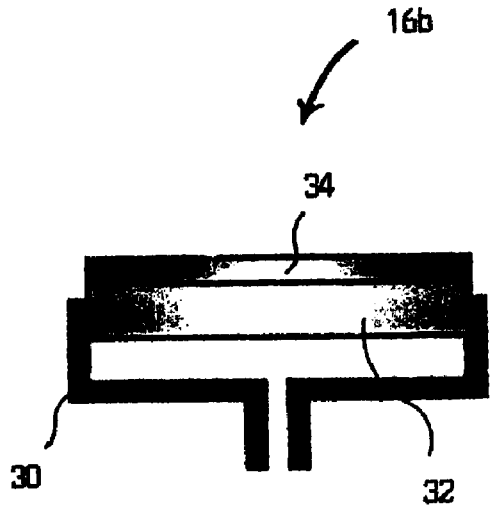
FIG. 3 is an explanatory side view showing a soft fixing plate structure for a thin-plate workpiece in the surface grinding device according to the present invention.

On the other hand, the soft fixing plate 16*b* is, as shown in FIG. 3, made up of a fixing plate 30, a flat hard plate 32 which is attached to the fixing plate 30 and made of a hard material such as a ceramic, and a soft material 34 which is stuck onto the upper surface of the hard plate 32.

The soft material 34 is formed of the soft material sheet, but is different from the soft chucking plate 16*a* shown in FIG. 2, there is no need of providing the chucking holes in the soft material sheet 34. The soft material sheet 34 is formed of a foamed resin sheet which is 1 mm or less in thickness and made of one or more kinds of materials selected from a group consisting of polystyrene resins, vinyl chloride resins, polyurethane resins, phenol resins, epoxy resins and polyethylene resins.

The thin-plate workpiece (W) is located on the hard plate 32 without accompanying elastic deformation, but is fixed onto the soft material sheet 34 surface due to a static friction which is caused between the thin-plate workpiece (W) and the soft material sheet by a vertical pressure when surface grinding the workpiece (W).

One example of a mechanism of an infeed surface grinding machine 40 which is one kind of the vertical spindle rotary table surface grinding machine to which the structure of the present invention is applied, will be described with reference to FIGS. 8 and 9. In those figures, a grinding wheel 42 is made up of a ring-shaped grinding wheel body 42*a* and a holding body 42*b* for holding the grinding wheel body 42*a* which is flattened and downwardly recessed in cross section. A rotary shaft 46 is attached on the upper surface of the holding body 42*b* along a center line thereof so as to be rotatable with a high accuracy by a spindle 44.

On the other hand, a rotary table 48 is arranged such that it is rotatable by a spindle 52 located below through surrounding a rotary shaft 50 with a high accuracy. Also, a chucking plate 54 formed of a porous ceramic body is attached onto an upper surface of the rotary table 48 on which the wafer (W) is located. A lower surface of the chucking plate 54 is connected to a vacuum unit 58 through a suction tube 56.

The above structure is identical with the structure of the conventional well-known infeed surface grinding machine. The feature of the present invention resides in that the soft material sheet 60, for example, a rubber soft material sheet large in a static frictional force to the wafer is stuck onto the upper surface of the chucking plate 54 in the well-known infeed surface grinding table. The soft material sheet 60 may be a porous soft material sheet.

A method of surface grinding the thin-plate workpiece according to the present invention is characterized by surface grinding a thin-plate workpiece having a sori(warp or bow) or waviness component using the above-mentioned device for surface grinding a thin-plate workpiece to remove the sori(warp or bow) or waviness component, thereby obtaining a thin-plate workpiece with a high flatness level.

Figure 4:
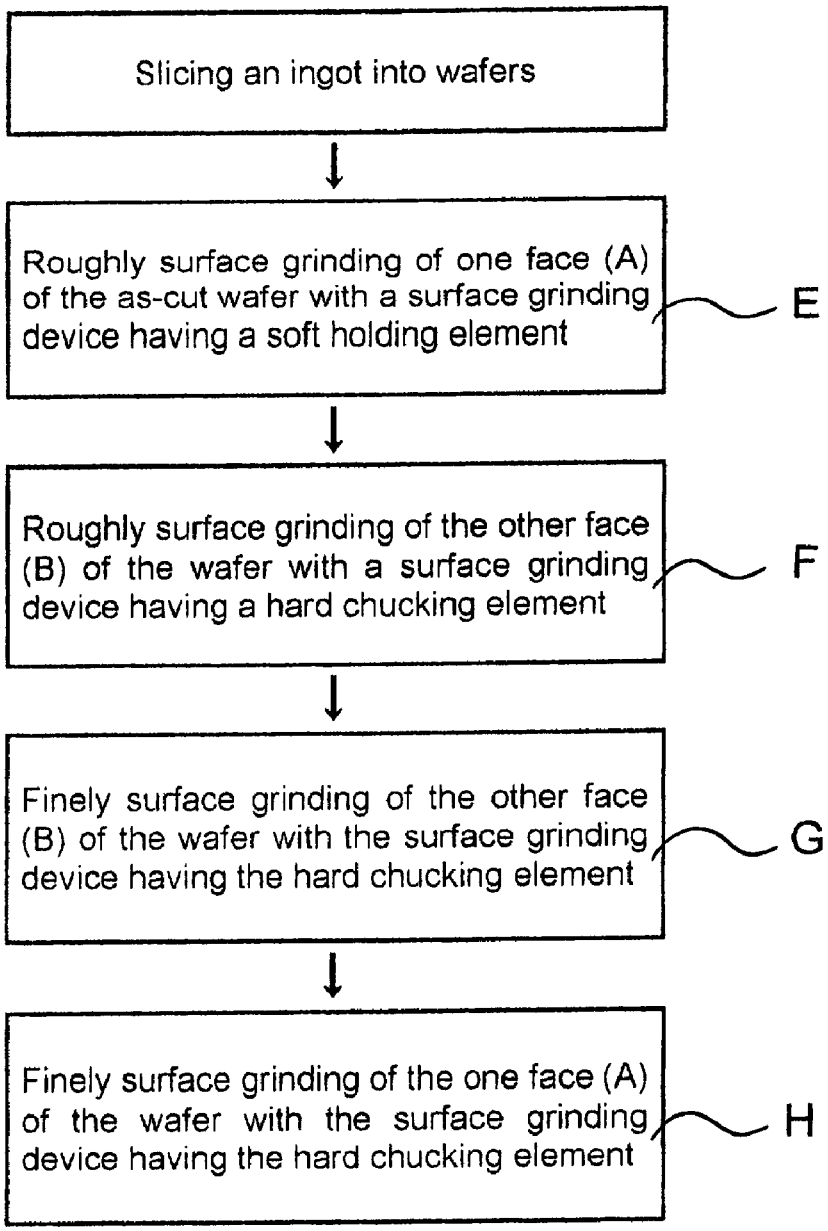
FIG. 4 is a flowchart showing one exemplary process in a surface grinding method according to the present invention.
Figure 5:
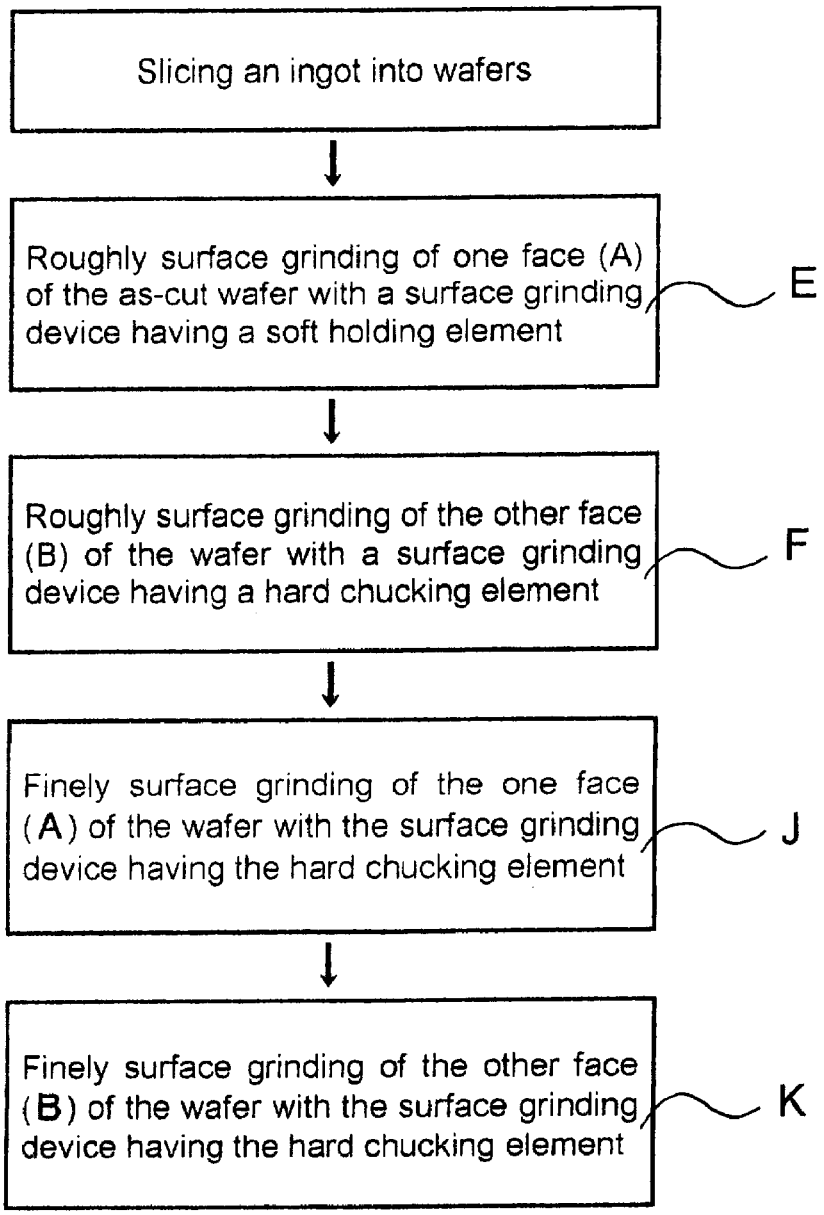
FIG. 5 is a flowchart showing another exemplary process in a surface grinding method according to the present invention.

Flowcharts of two modes for surface grinding both surfaces of the thin-plate workpiece to remove the sori(warp or bow) or waviness component, thereby obtaining a thin-plate workpiece such as a wafer with a high flatness level are shown in FIGS. 4 and 5. The method of surface grinding the thin-plate workpiece as shown in FIG. 4 is comprised of steps 1) to 4) stated below.

Figure 8:
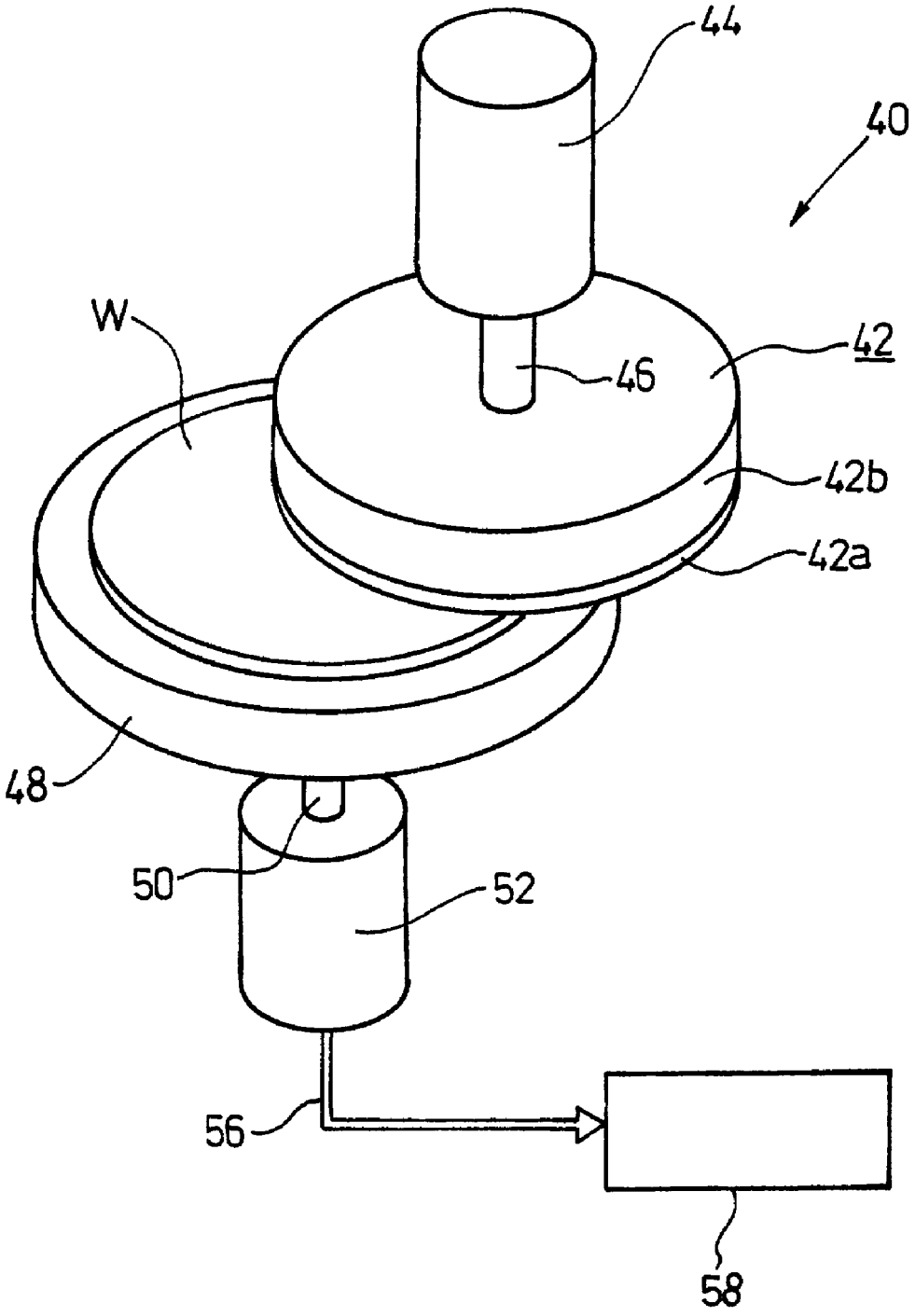
FIG. 8 is an explanatory perspective view showing an example in which the principle of the present invention is applied to an infeed type surface grinding device.
Figure 9:
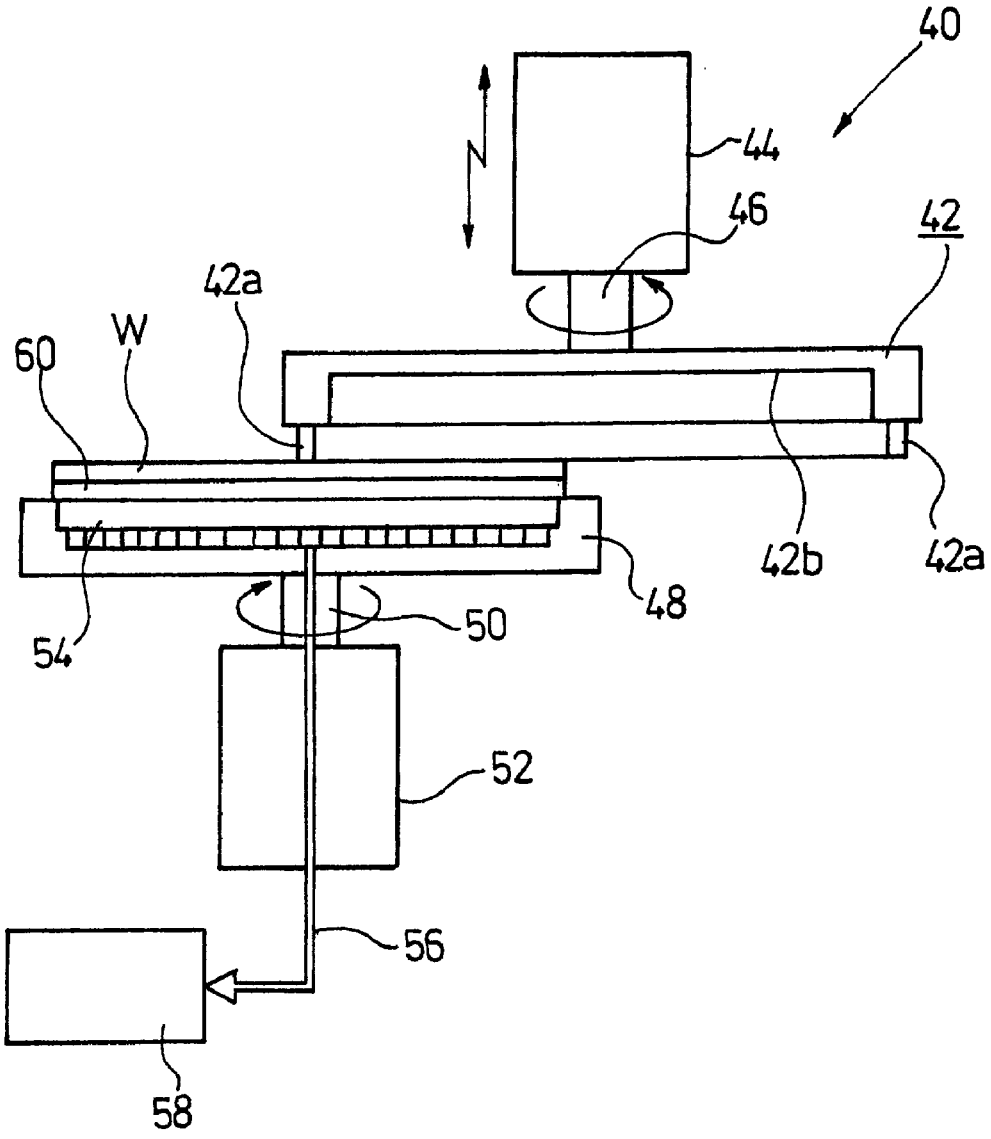
FIG. 9 is an explanatory side view of FIG. 8.

1) A step (E) of roughly surface grinding a surface (A) (one surface) of a wafer (an as-cut wafer) (W) immediately after having been sliced by a wire saw or an inner diameter saw with the surface grinding devices 16 and 40 shown in FIGS. 1 or 8 and 9, to create a reference plane (X) having no sori(warp or bow) or waviness. With creation of the reference plane (X), the hard chucking plate may be used in a succeeding process.
2) A step (F) of inverting the thin-plate workpiece (W) whose surface (A) has been roughly surface ground and, with the surface grinding device 72 having the hard chucking plate 76 as shown in FIGS. 10 and 11, chucking or holding and fixing the surface (A) to the hard chucking plate 76, to roughly surface grind a surface (B) (the other surface) of the thin-plate workpiece (W).
3) A step (G) of chucking or holding and fixing the surface (A) of the thin-plate workpiece (W) whose surface (B) has been roughly surface ground, with the surface grinding device 72 having the hard chucking plate 76, to the hard chucking plate 76, to further finely surface grind the surface (B) of the thin-plate workpiece (W).
4) A step (H) of inverting the thin-plate workpiece (W) whose surface (B) has been roughly surface ground and, with the surface grinding device 72 having the hard chucking plate 76, chucking or holding and fixing the surface (B) to the hard chucking plate 76 to finely surface grind the surface (A) of the thin-plate workpiece (W).

The surface grinding method for the thin-plate workpiece shown in FIG. 5 is made up of the following steps of 1) to 4).

Figure 10:
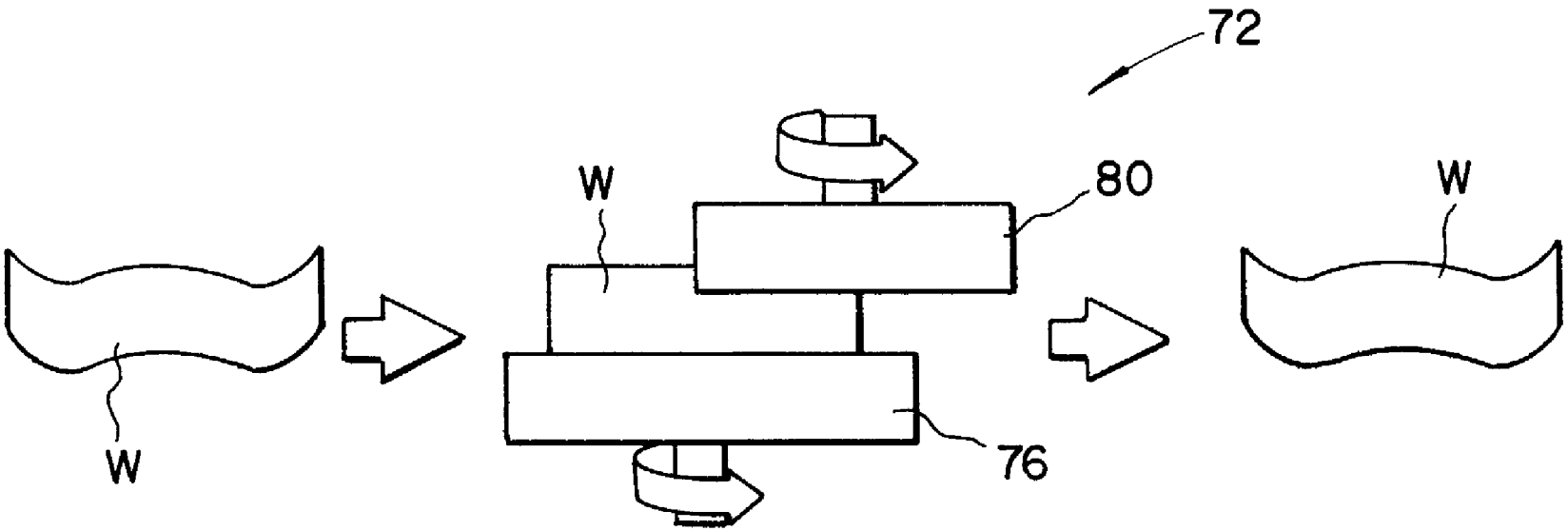
FIG. 10 PRIOR ART
FIG. 10 is an explanatory side view showing one example of conventional surface grinding devices.
Figure 11:
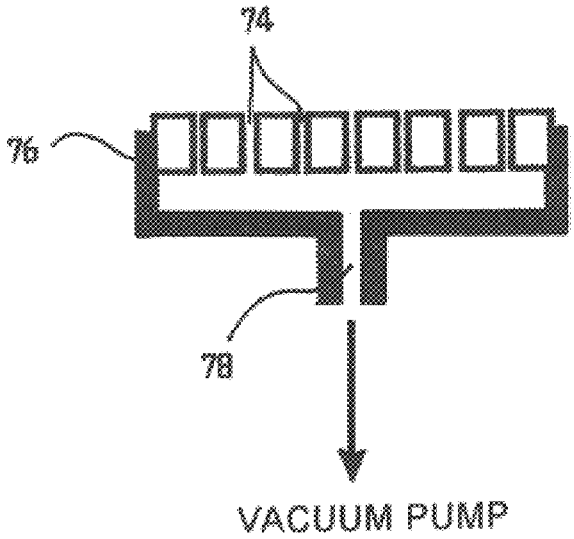
FIG. 11 PRIOR ART
FIG. 11 is an explanatory cross-sectional view showing a wafer chucking plate structure in the conventional surface grinding device.

1) A step (E) of roughly surface grinding a surface (A) (one surface) of a wafer (an as-cut wafer) (W) immediately after having been sliced by a wire saw or an inner diameter saw by the use of the surface grinding devices 16 and 40 shown in FIGS. 1 or 8 and 9, to create a reference plane (X) having no sori(warp or bow) or waviness.
2) A step (F) of inverting the thin-plate workpiece (W) whose surface (A) has been roughly surface ground and, with the surface grinding device 72 having the hard chucking plate 76 as shown in FIGS. 10 and 11, chucking or holding and fixing the surface (A) to the hard chucking plate 76, to roughly surface grind a surface (B) (the other surface) of the thin-plate workpiece (W).
3) A step (J) of inverting the thin-plate workpiece (W) whose surface (B) has been roughly surface ground and, with the surface grinding device 72 having the hard chucking plate 76, chucking or holding and fixing the surface (B) to the hard chucking plate 76 to finely surface grind the surface (A) of the thin-plate workpiece (W).
4) A step (K) of inverting the thin-plate workpiece (W) one surface (A) of which has been finely surface ground and, with the surface grinding device 72 having the hard chucking plate 76, chucking or holding and fixing the surface (A) to the hard chucking plate 76 to finely surface grind the surface (B) of the thin-plate workpiece (W).

In the above two modes of the surface grinding, the sori(warp or bow) or waviness of the thin-plate workpiece (W) is removed by the steps (E) and (F), thereby being capable of obtaining a ground thin-plate workpiece such as a ground wafer with a relatively excellent flatness. In the thin-plate workpiece (W) both surfaces of which have been roughly surface ground in the steps (E) and (F), the surfaces (A) and (B) are further finely surface ground in the steps (J) and (K), thereby being capable of obtaining a thin-plate workpiece (W) such as a wafer with a predetermined high flatness level.

Hereinafter, the present invention will be described in more detail with reference to examples.

(EXAMPLE 1)

Grinding procedure: Steps (E), (F), (G) and (H) shown in FIG. 4

Grinding device: In the step (E), there was used the surface grinding device of the present invention as shown in FIGS. 8 and 9, using a foamed polyethylene sheet about 0.5 mm in thickness as the soft material sheet 60. In the steps (F) to (H), the conventional surface grinding devices as shown in FIGS. 10 and 11 were used. In both of those surface grinding devices, #325 diamond grinding wheel was used in a rough grinding step, and #2,000 diamond grinding wheel was used in a fine grinding step.

Thin-plate workpiece to be ground: an as-cut wafer immediately after being sliced.

The amount of grinding: 50 $\mu$m/rough grinding ×2 surfaces, 30 $\mu$m/fine grinding ×2 surfaces.

Figure 6:
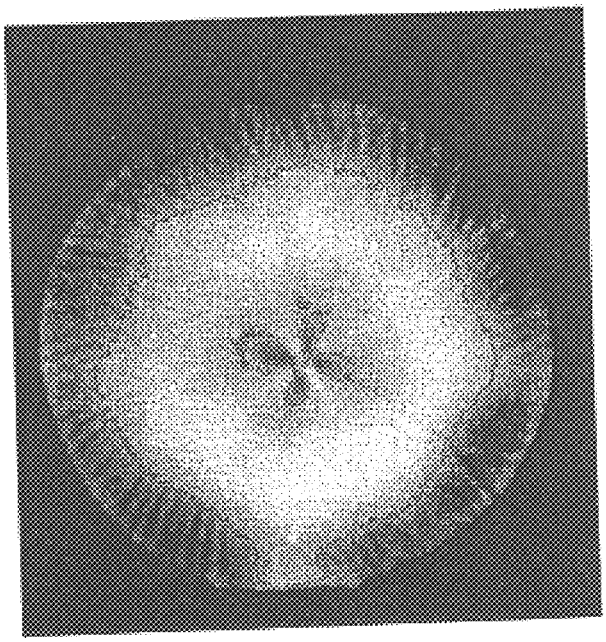
FIG. 6 is a photograph showing a surface configuration of a wafer that has been surface ground according to Example 1.

Under the above grinding conditions, a sample wafer was surface ground. The surface configuration of the wafer that has been surface ground was investigated using surface roughness measuring equipment which is based on the principle of a magic mirror. FIG. 6 is a photograph showing the surface configuration. It was confirmed that the waviness (vertical stripes) on the wafer surface was eliminated.

Figure 7:
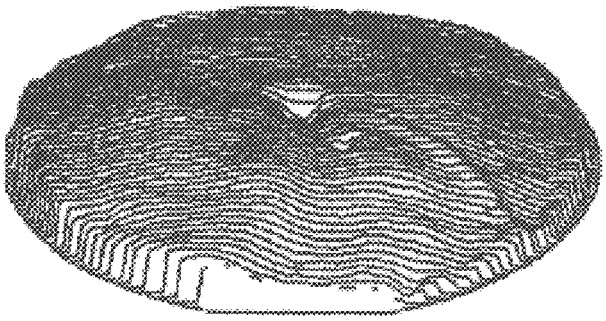
FIG. 7 is a diagram showing a flatness of a wafer that has been surface ground according to Example 1.

The flatness (TTV: Total Thickness Variation) of the ground surface of the wafer that has been surface ground was also measured for reference to be 0.9 $\mu$m. The surface flatness is schematically shown in FIG. 7.

(Comparative Example 1)

Figure 12:
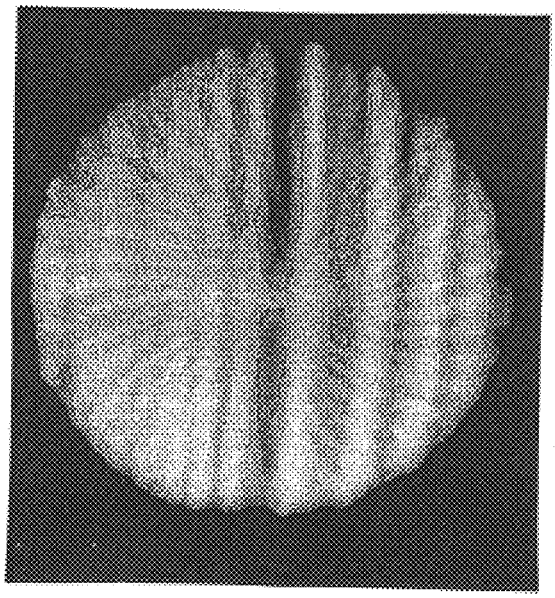
FIG. 12 is a photograph showing a surface configuration of a wafer that has been surface ground according to Comparative Example 1.

A sample wafer was surface ground under the same grinding conditions as that of Example 1 except that the surface (A) was roughly surface ground using the conventional surface grinding device shown in FIGS. 10 and 11 instead of the surface grinding device of the present invention which was used in the step (E) of Example 1. The surface configuration of the wafer that has been surface ground was investigated using surface roughness measuring equipment which is based on the principle of a magic mirror. FIG. 12 is a photograph of the surface configuration. It was found that waviness (vertical stripes) was exhibited on the wafer surface.

Figure 13:
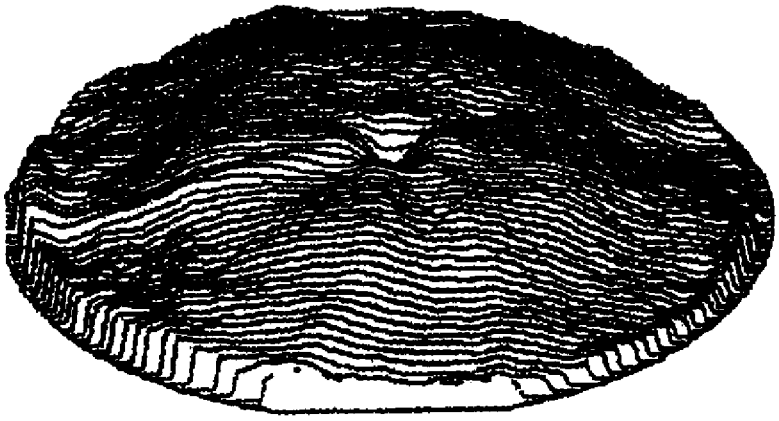
FIG. 13 is a diagram showing a flatness of a wafer that has been surface ground according to the Comparative Example 1.

The flatness (TTV) of the ground surface of the wafer that has been surface ground was also measured for reference to be 0.89 $\mu$m. The surface flatness is schematically shown in FIG. 13.

Comparing the above Example 1 with Comparative Example 1, it is found that the waviness (vertical stripes) of the wafer exhibited in Comparative Example 1 was eliminated. Also, there was no difference in the flatness between Example 1 and Comparative Example 1. Therefore, it was apparent that the present invention has a waviness removing effect, and is able to maintain the flatness of the ground wafer.

From the result of Example 1, the present invention is applicable for grinding processing instead of lapping or lapping and etching, with a starting material of an as-cut wafer having a sori(warp or bow) or waviness component immediately after being sliced. In particular, it was confirmed that the present invention can fabricate a wafer from which the waviness component was removed and which has a high flatness.

The foregoing description of preferred embodiments of the invention has been presented for purposes of illustration and description. It is not intended to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A surface grinding method for a thin-plate workpiece comprising the steps of:

roughly surface grinding a first surface of a thin-plate workpiece using a thin-plate workpiece surface grinding device to create a reference plane having no sori or waviness;

inverting the thin-plate workpiece, the first surface of which has been roughly surface ground and, with a surface grinding device having a hard chucking plate, chucking the first surface to said hard chucking plate to roughly surface grind a second surface of said thin-plate workpiece;

chucking to the hard chucking plate the first surface of the thin-plate workpiece, the second surface of which has been roughly surface ground with the surface grinding device having the hard chucking plate to further finely surface grind the second surface of said thin-plate workpiece; and inverting the thin-plate workpiece, the second surface of which has been finely surface ground and, with the surface grinding device having the hard chucking plate, chucking the second surface to the hard chucking plate to further finely surface grind the first surface of said thin-plate workpiece, wherein said surface grinding device comprising a surface grinding element; and a holding element for holding the thin-plate workpiece to be surface ground, wherein said holding element is a soft holding element.

2. A surface grinding method for a thin-plate workpiece as claimed in claim 1, wherein a holding surface of said soft holding element is made of a soft material.

3. A surface grinding method for a thin-plate workpiece as claimed in claim 1, wherein said soft holding element is formed of a thin-plate workpiece chucking plate on an upper surface of which a porous soft material sheet defining chucking holes for chucking the thin-plate workpiece therein is stuck.

4. A surface grinding method for a thin-plate workpiece as claimed in claim 3, wherein said porous soft material sheet is formed of a synthetic resin sheet made of one or more kinds of materials selected from a group consisting of polystyrene resins, vinyl chloride resins, polyurethane resins, phenol resins, epoxy resins and polyethylene resins.

5. A surface grinding method for a thin-plate workpiece as claimed in claim 1, wherein said soft holding element is formed of a thin-plate workpiece fixing plate on an upper surface of which a soft material sheet is stuck.

6. A surface grinding method for a thin-plate workpiece as claimed in claim 5, wherein said soft material sheet is formed of a foamed resin sheet which is 1 mm or less in thickness and made of one or more kinds of materials selected from a group consisting of polystyrene resins, vinyl chloride resins, polyurethane resins, phenol resins, epoxy resins and polyethylene resins.

7. A surface grinding method for a thin-plate workpiece as claimed in claim 1, wherein said thin-plate workpiece surface grinding device is a vertical spindle rotary table surface grinding machine.

8. A surface grinding method for a thin-plate workpiece as claimed in claim 1, wherein said thin-plate workpiece surface grinding device is an infeed grinding machine using a cup type grinding wheel.

9. A surface grinding method for a thin-plate workpiece as claimed in claim 1, wherein said thin-plate workpiece is a semiconductor wafer or a quartz wafer.

10. A surface grinding method for a thin-plate workpiece comprising the steps of:

roughly surface grinding a first surface of a thin-plate workpiece using a thin-plate workpiece surface grinding device to create a reference plane having no sori or waviness;

inverting the thin-plate workpiece, the first surface of which has been roughly surface ground and, with a surface grinding device having a hard chucking plate, chucking the first surface to said hard chucking plate to roughly surface grind a second surface of said thin-plate workpiece;

chucking to the hard chucking plate the second surface of the thin-plate workpiece, the second surface of which has been roughly surface ground with the surface grinding device having the hard chucking plate to finely surface grind the first surface of said thin-plate workpiece; and inverting the thin-plate workpiece, the first surface of which has been finely surface ground and, with the surface grinding device having the hard chucking plate, chucking the second surface to the hard chucking plate to finely surface grind the second surface of said thin-plate workpiece, wherein said surface grinding device comprising a surface grinding element; and a holding element for holding the thin-plate workpiece to be surface ground, wherein said holding element is a soft holding element.

11. A surface grinding method for a thin-plate workpiece as claimed in claim 10, wherein said thin-plate workpiece is a semiconductor wafer or a quartz wafer.

12. A surface grinding method for a thin-plate workpiece as claimed in claim 10, wherein a holding surface of said soft holding element is made of a soft material.

13. A surface grinding method for a thin-plate workpiece as claimed in claim 10, wherein said soft holding element is formed of a thin-plate workpiece chucking plate on an upper surface of which a porous soft material sheet defining chucking holes for chucking the thin-plate workpiece therein is stuck.

14. A surface grinding method for a thin-plate workpiece as claimed in claim 13, wherein said porous soft material sheet is formed of a synthetic resin sheet made of one or more kinds of materials selected from a group consisting of polystyrene resins, vinyl chloride resins, polyurethane resins, phenol resins, epoxy resins and polyethylene resins.

15. A surface grinding method for a thin-plate workpiece as claimed in claim 10, wherein said soft holding element is formed of a thin-plate workpiece fixing plate on an upper surface of which a soft material sheet is stuck.

16. A surface grinding method for a thin-plate workpiece as claimed in claim 15, wherein said soft material sheet is formed of a foamed resin sheet which is 1 mm or less in thickness and made of one or more kinds of materials selected from a group consisting of polystyrene resins, vinyl chloride resins, polyurethane resins, phenol resins, epoxy resins and polyethylene resins.

17. A surface grinding method for a thin-plate workpiece as claimed in claim 10, wherein said thin-plate workpiece surface grinding device is a vertical spindle rotary table surface grinding machine.

18. A surface grinding method for a thin-plate workpiece as claimed in claim 10, wherein said thin-plate workpiece surface grinding device is an infeed grinding machine using a cup type grinding wheel.

* * * * *